United States Patent [19]

Cartwright

[11] 4,383,830

[45] May 17, 1983

[54] ROWING RIGS

[76] Inventor: Andrew S. Cartwright, 13, Broad St., Hay-on-Wye, Hereford, England

[21] Appl. No.: 128,369

[22] Filed: Mar. 6, 1980

[30] Foreign Application Priority Data

Mar. 14, 1979 [GB] United Kingdom ..... 7909029

[51] Int. Cl.[3] ..... B63H 16/04

[52] U.S. Cl. ..... 440/104; 440/105; 440/106

[58] Field of Search ..... 440/104, 105, 106, 25, 440/32

[56] References Cited

U.S. PATENT DOCUMENTS

| | | | |
|---|---|---|---|
| 577,200 | 2/1897 | Nordwall | 440/25 |
| 1,021,721 | 3/1912 | Keddy | 440/106 |
| 3,003,457 | 10/1961 | Patterson | 440/25 |

FOREIGN PATENT DOCUMENTS

| | | | |
|---|---|---|---|
| 149153 | 11/1950 | Australia | 440/105 |
| 27152 | 7/1916 | Norway | 440/106 |
| 4550 | of 1884 | United Kingdom | 440/106 |
| 804510 | 11/1958 | United Kingdom | 440/105 |

*Primary Examiner*—Sherman D. Basinger

*Attorney, Agent, or Firm*—Young & Thompson

[57] ABSTRACT

A rowing boat 10 has a fixed seat 14 and a movable foot stretcher 16 slidably mounted in guides 15. A swinging outrigger arm 17 is provided to support an oar by means of row lock 22 at its outer end. The inner end of outrigger 17 is pivotally mounted on a vertical axis 21. A coupling link 24 connects the stretcher to the outrigger 17, whereby as the stretcher is moved fore-and-aft during rowing the outrigger 17 is pivoted about axis 21. The link 24 is connected to the outrigger 17 at a point which is adjustable, and is always inboard of the rowlock. In an alternative embodiment the outrigger 17 is provided with a lifting member 33 which assists in raising the blade of the oar.

2 Claims, 6 Drawing Figures

ROWING RIGS

This invention relates to rowing rigs for rowing vessels and to outriggers for such rowing rigs.

According to the present invention there is provided a rowing rig for a boat comprising a rowlock mountable on the boat for fore-and-aft movement relative to the boat and a stretcher mountable on the boat for fore-and-aft movement relative to the boat, the rowlock and the stretcher being drivingly connected.

According to the present invention there is provided a rowing rig for a rowing vessel having a fixed seat, the rig comprising a stretcher, guide means mountable on the vessel to define, in use, a path of travel for the stretcher, the path of travel extending along the vessel, means for limiting the movement of the stretcher along its path of travel, at least one arm having means for pivotably supporting an oar at one end thereof, means for pivotably mounting the arm on the boat adjacent the seat, and means for drivingly coupling a stretcher to the arm whereby, in use, backwards and forwards movement of the stretcher along its path of travel causes corresponding rotation of the arm.

The rig may further comprise a plurality of arms which may be mountable alternately on opposite sides of the vessel.

The or each arm may be an outrigger. Each outrigger may be pivotably mounted about an axis extending, in use, vertically through the vessel.

Alternatively the or each arm may extend vertically upwardly to support an oar adjacent the gunwales of the boat. In this case the or each arm is mounted in line for pivotable movement about a generally horizontally extending axis. The or each arm may pass through a slot extending, in use, along the side of the boat in which case the ends of the slot limit the movement of the arm.

The coupling means may be adjustable to adjust the extent of arc swept by the arm per unit length of movement of the stretcher along its path of travel.

The coupling means may include means for varying the point of connection of the coupling means to the arm along at least a part of the arm.

The means for limiting movement of the stretcher along its path of travel may comprise elongate resilient means having one end securable to the vessel adjacent the seat and the other end connected to the stretcher and arm assembly. Alternatively the means for limiting movement of the stretcher may be constituted by stops mounted on the guide means.

The coupling means may comprise an elongate member collapsible transversely when it experiences a force above a pre-determined level.

According to an aspect of the present invention there is provided an outrigger for supporting an oar comprising a member mountable on a vessel to extend upwardly therefrom, an elongate member having one end pivotably connected to the first mentioned member and extending away therefrom, a further member pivotably mounted at the other end of the elongate member to depend therefrom, means interconnecting the further member at a point below the other end of the elongate member to the first mentioned member at a point above the one end of the elongate member, the further member having means for supporting an oar between the ends thereof the arrangement being such that when, in use, a force is applied to the oar in a sense to upwardly pivot the blade of the oar the apparent point of pivot lies between the means for supporting the oar and the grip of the oar.

The interconnecting means may pass through the elongate member.

The invention may further include a rowing rig having an outrigger as set out above.

The invention may still further include a rowing boat having a fixed seat and a rowing rig as set out about above.

Specific embodiments of the invention will now be described with reference to the accompanying drawings, in which.

Figure 4B:
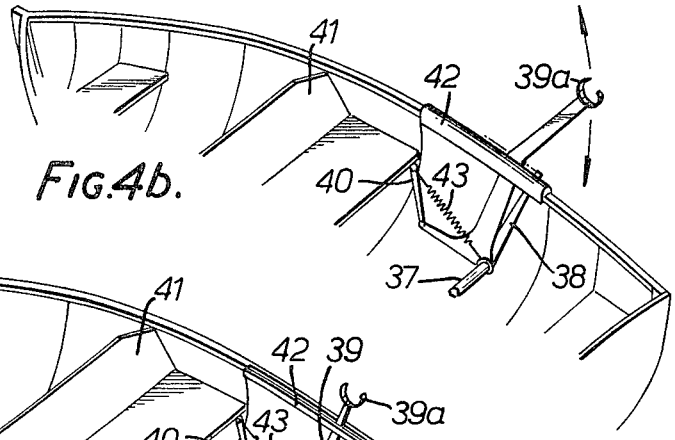
Figure 4A:
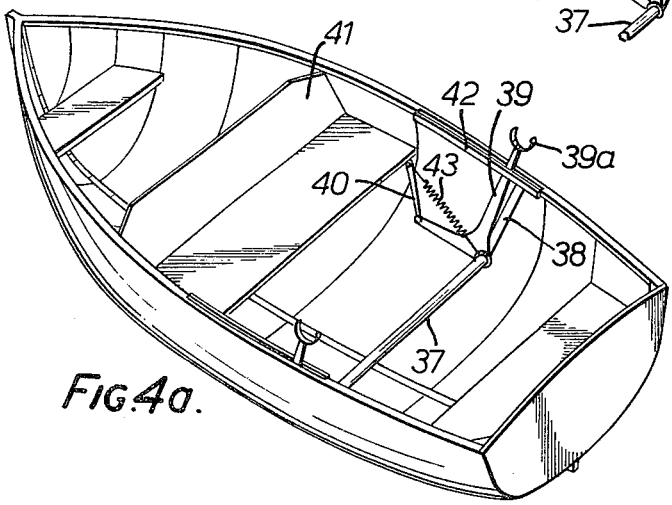
Figure 5:
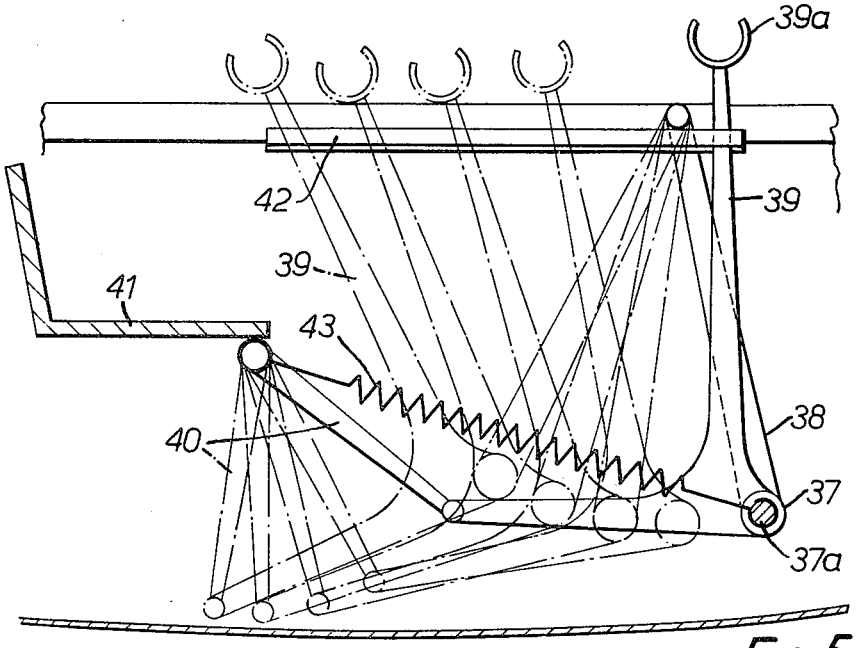

FIG. 4*a* is a perspective view from above of a rowing boat;

FIG. 4*b* is a scrap view of FIG. 4*a* showing an alternative embodiment of a rowing rig, and FIG. 5 is an enlarged side view of the rowing rig of FIG. 4*a* with a movement of the rig in use indicated in chain line.

Figure 1:
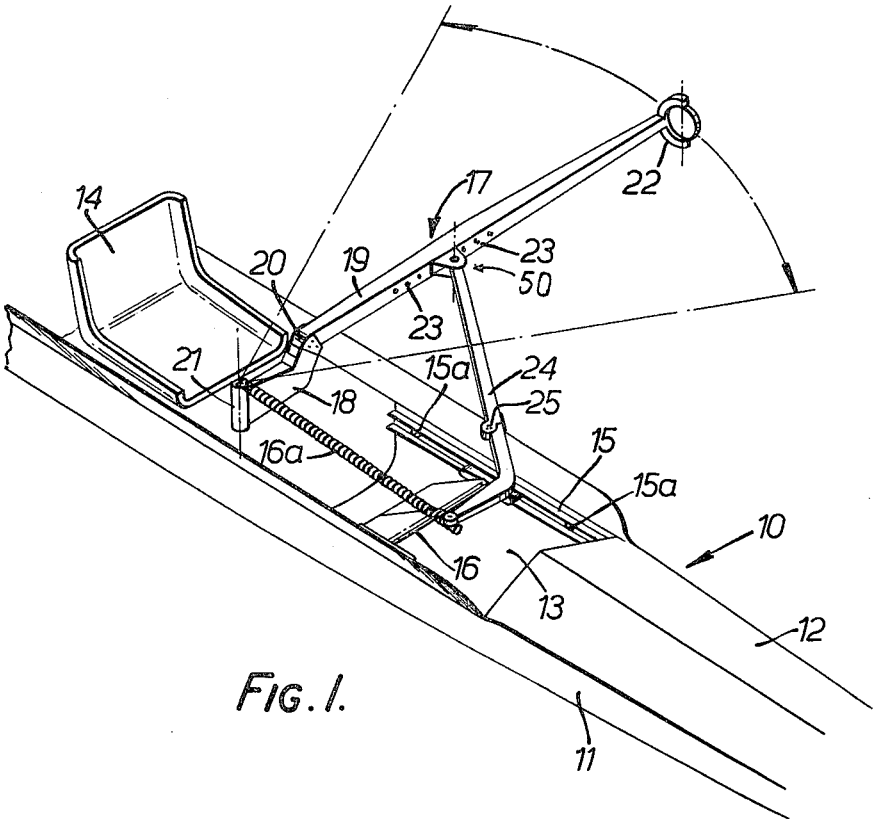
FIG. 1 is a perspective view of the sternmost seat of a pair.

FIG. 1 shows a part of a pair, generally indicated at 10. As is well known such vessels comprise an elongate hull 11 having decked-in-portions at their bow and stern (the stern portion is indicated at 12) and an open cockpit indicated at 13 extending between these deck portions. In a pair two seats are provided in this cockpit and in traditional pairs these seats are slidable. In the pair of FIG. 1 the seat 14 is fixed relative to the bow 11, although in certain circumstances the seat 14 may be capable of limited movement.

Channel shaped guide tracks 15 are secured by means of screws 15*a* either side of the cockpit 11, sternwards of seat 14 and adjacent the gunwales of the vessel 10. The guide tracks 15 are aligned and parallel and are arranged to slidably receive the ends of stretcher 16. A return spring 16*a* may be connected between stretcher 16 and a part of the boat adjacent seat 14, to assist the return of the stretcher to the forward end of the guides 15.

An outrigger generally indicated at 17 comprises a cranked portion 18 and an arm 19, which are joined together by a friction joint 20. The free end of crank portion 18 is mounted on a vertically extending axle 21, which is secured to the hull 11 beneath the seat 14.

The arm 19 extends transversely out from the pair 10 and has a rowlock 22 mounted at its free end. A number of spaced locating holes 23 are formed in the mid-portion of arm 19. Preferably the locating holes 23 lie between the limits 0.4 and 0.6 times the length of the outrigger arm measured from axle 21.

The locating holes 23 provide means for securing one end of a coupling element 24 to the arm 14, the other end of the element 24 being secured to the stretcher.

The coupling element 24 is preferably provided with means for folding or collapsing transversely in the manner of a jack-knife, in order harmlessly to relieve the force on the outrigger arm 19 in the case of a collision or other mishap. For example such means may be constituted by a hinge joint, having a vertical axis, at 25 in combination with a spring or catch of moderate strength to hold it in the normal operating position.

The same mechanism may be released when it is desired to swing the outrigger arm 19 into a longitudinal position for convenience in transport or storage.

In use a rower mounts an oar (not shown) on rowlock 22 and rows with a normal action. However, in this case the stretcher 16 slides up and down guide tracks 15 whilst seat 14 remains practically stationary. The forward and aft movement of the stretcher during each stroke drives by means of coupling element 24 arm 19 and hence rowlock 22 through the arc indicated in FIG. 1. The effect of this arrangement is two-fold. First, as will be better seen in FIG. 2, which shows a single scull, the pivoting of arm 19 about axle 21 allows a longer pull to occur through water for each stroke and hence increases available driving power. The size of the arc of movement of arm 19 and hence the length of pull can be varied by altering the locating hole 23 into which the one end of coupling means 24 is secured. The nearer the selected hole 23 is to axle 21 the greater the arc per unit length of movement of stretcher 16.

The second effect of the assembly comprising outrigger 17, coupling means 24 and the slide portion stretcher 16 is that as the seat 14 is fixed and the stretcher 16 is movable the propulsive force is at least partially transmitted through the backrest 14. For this reason it is desirable to have at least some padding or air-cushioning on seat 14. It will also be appreciated that as seat 14 is fixed the transference of weight bow-to-stern during the rowing action is greatly reduced and hence there is a reduction of fore-and-aft oscillation of the boat.

Figure 2:
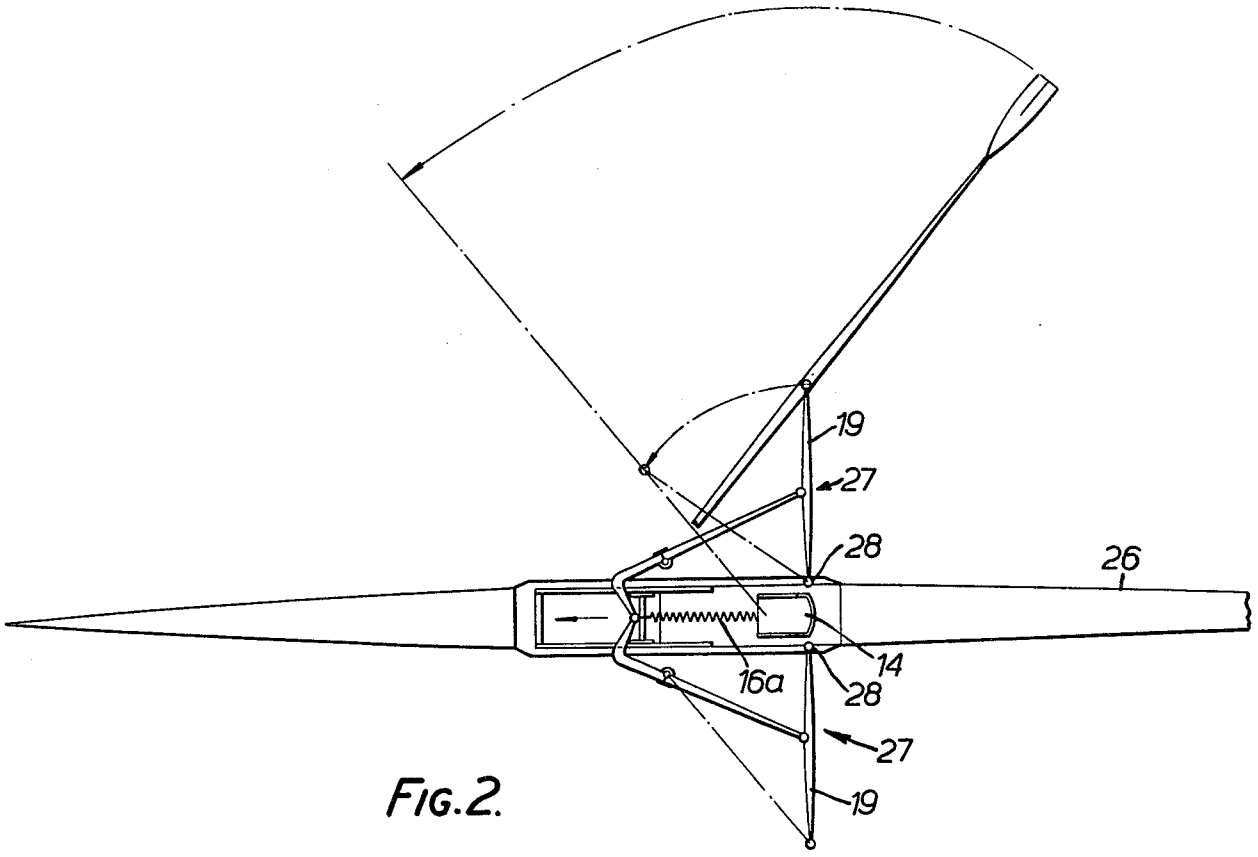
FIG. 2 is a schematic view from above of a single scull.

FIG. 2 shows a single scull generally indicated at 26. It will be noted that there is a rowing rig 27 on either side of seat 14 and that each outrigger arm 19 is connected to a vertical axle 28 adjacent the backrest of seat 14 and on its respective side thereof. The increase in pull length gained from the rigs 27 is clearly shown by FIG. 2.

Figure 3:
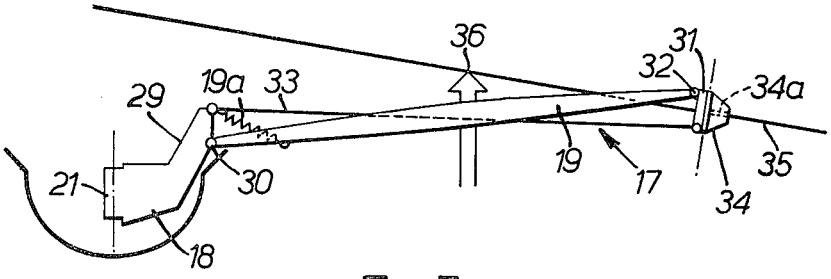
FIG. 3 is a cross-sectional view of a pair.

FIG. 3 shows an alternative form of outrigger 17. In this embodiment arm 19 is secured to an upstanding flange portion 29 of crank portion 18 by means of a hinge 30. Hinge 30 has a horizontal extending axis. A depending flange 31 is hingedly secured to the free end of arm 19 by means of hinge 32, which again has a horizontal extending axis. Flanges 29 and 31 are further interconnected by means of a member 33 which extends from the top of flange 29 to the bottom of flange 31 through a channel (not shown) in arm 19. Each end connection of member 33 is free to pivot. A further flange 34 is hinged to flange 31 about a generally vertical axis and in turn has an oar 35 hinged thereon. The oar is hinged at **34*a* about a generally horizontal axis extending parallel to the axis of the oar. The two hinges secured to flange 34 provide the oar with movement about both vertical and horizontal axes. It will be appreciated that other means of connecting the oar 35 to the flange 31, which provided this degree of freedom of movement would be suitable. Preferably the connection of the oar to flange 34 should allow the oar to be releasable from flange 34. A spring 19*a* may be connected between flange 29 and arm 19** to counterbalance the weight of the oar.

In use, when it is desired to raise the blade of the oar 35 from the water a downward force is applied to the other end of the oar 35 by the rower. This downward force causes flange 31 to be drawn away from the end of the end of arm 19 and hence pulling on member 33. The pull on member 33 lifts the outward end of arm 19 and thus the oar apparently pivots about the fulcrum indicated at 36, rather than about hinge 32. Therefore for a given effort the blade of the oar is lifted from the water more quickly. It is envisaged that such an arrangement would be particularly useful in a hydrofoil vessel.

In either of the above arrangements the channel-shaped guide tracks may be replaced by two or more spaced parallel guide tubes (not shown) in which case the stretcher may be mounted on the tubes by P.T.F.E. or low friction bushs mounted on the tubes. In addition a further guide may be located on or adjacent the bottom of the boat extending axially.

FIGS. **4*a* and 5 showing a rowing rig for a conventional rowing boat. In this embodiment the stretcher 37 is supported on depending arms 38 by means of an inner rod 37*a* to allow fore-and-aft movement in the manner of a swing or trapeze. The rod 37*a* is rigidly connected to arms 38 on either side of the boat. Arm 39 is suspended between the stretcher 37 and a further depending arm 40, which is pivotally secured adjacent seat 41. Stretcher 37 is rigidly connected to arm 39. The arm 39 extends upwardly to the gunwales of the boat through a guide 42, which allows limited horizontal movement of the arm 39 in the manner shown in FIG. 5. A return spring 43 extends from the boat to stretcher 36. Alternatively the return spring may be constituted by a torque rod or by a coil spring in one of the joints of the rig. The rigid connection of the stretcher 37 and rod 37*a* to arms 39 and 38 respectively on either side of the boat maintain rowlocks 39*a*, connected at the free ends of arms 39**, in phase.

FIG. **4*b* shows an alternative embodiment in which the arm 39 is extended and hinged above the gunwales of the boat so as to form a horizontal outrigger. The arm 39 is free to move up and down and is provided with a counterbalancing spring to prevent the arm 39 from disengaging the oar. In use the oar rests on the guide 42, which may be suitably modified for this purpose. Thus the oar pivots at the rowlock 39*a*** during horizontal or driving motion and at the guide during vertical or lifting motion.

In both these embodiments movement of the rowlock by the stretcher increases the length of the pull of the blade and also power is transmitted through the fixed seat 41 on the boat.

It will be noticed that the invention provides connecting means between the movable foot stretcher and the rowlock which generate a mechanical advantage or velocity ratio between the longitudinal movements of said two parts. In the FIG. 1 embodiment this connecting means comprises the pivoted connecting or coupling element 24 attached to a pivot point 50 on the arm 17 inboard of the rowlock 22. In the embodiment of FIG. 5 the connecting or coupling element means comprises the bell crank arm 39 combined with the pivoting connecting link 40. In the illustrated embodiments the mechanical advantage or velocity ratio is about 1:1.5 i.e. less than 1:1.

For purposes of the present application, the velocity ratio is defined as the ratio of the distance through which the point of application of the applied force moves, to the distance through which the point of application of the resistance moves in the same period of time.

I claim:

1. An outrigger for supporting an oar comprising, a support, means for mounting the support on a boat to extend upwardly therefrom, an elongate link, means for pivotally connecting one end of the elongate link to the support such that the elongate link extends away therefrom, a carrier, means for pivotally mounting the carrier at the other end of the elongate link such that it depends therefrom, means for interconnecting the carrier at a point below said other end of the elongate link to the support at a point above the one end of the elongate link, the interconnecting means passing through the elongate link, and means for supporting an oar between the ends thereof on the carrier, the arrangement being such that when a force is applied to the oar in a sense to upwardly pivot the blade of the oar the apparent point of pivot lies between the carrier and the grip of the oar.

2. A rowing rig for a boat, comprising a pair of upright arms at either side of the boat, the upper ends of the arms being mounted for pivotal movement about a common horizontal axis extending transversely of the boat, a stretcher extending between and carried by the lower ends of said arms, further arms upstanding from said stretcher, rowlocks carried by the upper ends of said further arms adjacent the gunwales of the boat, guide means for guiding the further arms for fore-and-aft movement, and link means pivotally interconnecting the further arms and the boat to maintain said further arms upright upon swinging movement of the stretcher about said common horizontal axis.

* * * * *